US011341930B2

(12) United States Patent
Yang et al.

(10) Patent No.: US 11,341,930 B2
(45) Date of Patent: May 24, 2022

(54) ERASING UNIT FOR IMAGE STICKING, CONTROL METHOD THEREOF, AND LIQUID CRYSTAL DISPLAY DEVICE

(71) Applicants: HEFEI BOE DISPLAY TECHNOLOGY CO., LTD., Ahnui (CN); BOE TECHNOLOGY GROUP CO., LTD., Beijing (CN)

(72) Inventors: Xiuqin Yang, Beijing (CN); Siying Lu, Beijing (CN); Huiming Wang, Beijing (CN); Wenbo Dong, Beijing (CN)

(73) Assignees: HEFEI BOE DISPLAY TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 478 days.

(21) Appl. No.: 16/332,761

(22) PCT Filed: Aug. 14, 2018

(86) PCT No.: PCT/CN2018/100426
§ 371 (c)(1),
(2) Date: Mar. 12, 2019

(87) PCT Pub. No.: WO2019/153693
PCT Pub. Date: Aug. 15, 2019

(65) Prior Publication Data

US 2021/0304699 A1 Sep. 30, 2021

(30) Foreign Application Priority Data

Feb. 7, 2018 (CN) ..... 201810124928.9

(51) Int. Cl.
*G09G 3/36* (2006.01)

(52) U.S. Cl.
CPC ..... *G09G 3/3696* (2013.01); *G09G 3/3648* (2013.01); *G09G 2300/0842* (2013.01); *G09G 2310/08* (2013.01); *G09G 2320/0257* (2013.01)

(58) Field of Classification Search
CPC ..... G09B 3/3696; G09B 3/3648; G09B 2300/0842; G09B 2310/08; G09B 2320/0257
See application file for complete search history.

(56) References Cited

U.S. PATENT DOCUMENTS 9,501,997 B2 11/2016 Huang et al.
2006/0022971 A1* 2/2006 Luo ..... G09G 3/3648 345/211

(Continued)

FOREIGN PATENT DOCUMENTS

CN 1801303 A 7/2006
CN 101546529 A 9/2009

(Continued)

OTHER PUBLICATIONS

First Chinese Office Action dated Dec. 23, 2019, for corresponding Chinese Application No. 201810124928.9.

(Continued)

*Primary Examiner* — Kent W Chang
*Assistant Examiner* — Sujit Shah
(74) *Attorney, Agent, or Firm* — Kinney & Lange, P.A.

(57) ABSTRACT

Embodiments of the present disclosure provide an erasing unit for image sticking in a liquid crystal display device, a control method thereof and a liquid crystal display device. A first controlling signal may be generated by dividing a voltage at a DC power supply terminal. A controlling circuit may output a second controlling signal and a third controlling signal in responding to the voltage of the first control- (Continued)

ling signal being smaller than or equal to a reference voltage. A charging and discharging circuit may discharge under the control of the second controlling signal and output a high-level voltage signal to an outputting circuit. The outputting circuit may supply the high-level voltage signal outputted by the charging and discharging circuit to TFTs in the liquid crystal display device, controlling the TFTs to be turned on.

16 Claims, 5 Drawing Sheets

(56) References Cited

U.S. PATENT DOCUMENTS

| | | | | |
|---|---|---|---|---|
| 2007/0091040 | A1 | 4/2007 | Wu | |
| 2008/0062072 | A1 | 3/2008 | Yang et al. | |
| 2011/0292005 | A1 | 12/2011 | Lau et al. | |
| 2011/0310135 | A1* | 12/2011 | Feng | G09G 3/3648 345/690 |
| 2015/0009202 | A1* | 1/2015 | Cho | G09G 3/20 345/212 |
| 2015/0179128 | A1* | 6/2015 | Huang | H03K 19/018521 315/169.1 |
| 2018/0330684 | A1 | 11/2018 | Guo et al. | |

FOREIGN PATENT DOCUMENTS

| | | | |
|---|---|---|---|
| CN | 103236234 | A | 8/2013 |
| CN | 104778933 | A | 7/2015 |
| CN | 104795040 | A | 7/2015 |
| CN | 105632435 | A | 6/2016 |
| JP | 2013080122 | A | 5/2013 |

OTHER PUBLICATIONS

International Search Report and English Translation of Box V of the Written Opinion dated Nov. 22, 2018, received for corresponding PCT Application No. PCT/CN2018/100426.

Extended European Search Report dated Oct. 8, 2021, received for corresponding European Application No. 18852772.5, ten pages.

* cited by examiner

ERASING UNIT FOR IMAGE STICKING, CONTROL METHOD THEREOF, AND LIQUID CRYSTAL DISPLAY DEVICE

CROSS-REFERENCE TO RELATED APPLICATION(S)

This application is a Section 371 National Stage Application of International Application No. PCT/CN2018/100426, which claims the priority of Chinese Patent Application No. 201810124928.9, filed on Feb. 7, 2018, the entire contents of which are hereby incorporated by reference.

TECHNICAL FIELD

Embodiments of the present disclosure relate to the field of display technologies, and in particular, to an erasing unit for image sticking, a control method thereof and a liquid crystal display device.

BACKGROUND

A liquid crystal display (LCD) generally comprises an array substrate and a color filter substrate disposed opposite to each other and a liquid crystal layer disposed between the array substrate and the color filter substrate. During the displaying of the LCD, liquid crystal molecules are controlled to deflect by applying voltages to pixel electrodes on the array substrate and common electrodes on the color filter substrate, respectively. However, since there are capacitors in the LCD, some of charges may be stored on the pixel electrodes. If the charges stored in the LCD cannot be effectively released, it will result in image sticking when the LCD is turned off, i.e. an afterimage may be appeared. This may further cause a problem of shutdown afterimage.

SUMMARY

According to an aspect of embodiments of the disclosure, there is provided an erasing unit for image sticking in a liquid crystal display device, comprising:

a controlling circuit, configured to receive a first controlling signal, and output a second controlling signal and a third controlling signal in response to a voltage of the first controlling signal being less than or equal to a reference voltage;

a charging and discharging circuit, configured to output a high-level voltage signal under a control of the second controlling signal; and an outputting circuit, configured to output the high-level voltage signal to a gate of a thin film transistor in the liquid crystal display device under a control of the third controlling signal.

For example, the charging and discharging circuit comprises: a storage capacitor and a first transistor, wherein: the storage capacitor has a first electrode coupled to a high-level voltage signal terminal and a first electrode of the first transistor, and a second electrode coupled to a ground terminal; and the first transistor has a gate coupled to the controlling sub-circuit and configured to receive the second controlling signal, and a second electrode coupled to the outputting sub-circuit and configured to output the high-level voltage signal.

For another example, the charging and discharging circuit further comprises: a first rectifier diode, a second rectifier diode, a third rectifier diode, and a fourth rectifier diode; wherein the high-level voltage signal terminal is coupled to the first electrode of the storage capacitor via the first rectifier diode and coupled to the second electrode of the storage capacitor via the second rectifier diode, and the ground terminal is coupled to the first electrode of the storage capacitor via the third rectifier diode, and coupled to the second electrode of the storage capacitor through the fourth rectifier diode;

the first rectifier diode has an anode coupled to the high-level voltage signal terminal and a cathode of the second rectifier diode respectively, and a cathode coupled to the first electrode of the storage capacitor and a cathode of the third rectifier diode respectively;

the second rectifier diode has an anode coupled to the second electrode of the storage capacitor and an anode of the fourth rectifier diode respectively; and the third rectifier diode has an anode coupled to the ground terminal and a cathode of the fourth rectifier diode respectively.

For another example, the controlling circuit comprises: a comparing sub-circuit, a selecting sub-circuit, a timing sub-circuit, and an inverting sub-circuit, wherein:

the comparing sub-circuit is configured to receive the first controlling signal and a reference voltage signal, output a first selecting signal to the selecting sub-circuit in response to the voltage of the first controlling signal being less than or equal to the reference voltage of the reference voltage signal; and output a second selecting signal to the selecting sub-circuit in response to the voltage of the switching controlling signal being greater than the reference voltage of the reference voltage signal;

the selecting sub-circuit is configured to output a timing controlling signal of a first level to the timing sub-circuit under a control of the first selecting signal; and output a timing controlling signal of a second level to the timing sub-circuit under a control of the second selecting signal;

the timing sub-circuit is configured to time a duration of the timing controlling signal of the first level, output a conduction controlling signal to the charging and discharging circuit and the inverting sub-circuit during a period of time with a duration being less than or equal to a threshold duration, and disable the erasing unit under the control of the timing controlling signal of the second level; and the inverting sub-circuit is configured to invert the conduction controlling signal and output the inverted signal to the outputting sub-circuit as the third controlling signal.

For another example, the comparing sub-circuit comprises a comparator, wherein the comparator has a negative phase inputting terminal coupled to the voltage dividing circuit and configured to receiving the switching controlling signal, and a positive phase inputting terminal configured to receive the reference voltage signal, and an outputting terminal coupled to the selecting sub-circuit and configured to output the first selecting signal or the second selecting signal.

For another example, the selecting sub-circuit comprises a second transistor and a first resistor; the second transistor has a controlling electrode coupled to the comparing sub-circuit and configured to receive the first selecting signal or the second selecting signal, a first electrode coupled to the ground terminal, and a second electrode coupled to a first terminal of the first resistor and the timing sub-circuit respectively and configured to output the timing controlling signal; and the first resistor has a second electrode coupled to the reference signal terminal.

For another example, the reference signal terminal and the DC power supply terminal are the same signal terminal.

For another example, the timing sub-circuit comprises a timer, wherein: the timer has a controlling terminal coupled to the selecting sub-circuit and configured to receive the timing controlling signal, and an outputting terminal coupled to the inverting sub-circuit and the charging and discharging circuit and configured to output the conduction controlling signal.

For another example, the inversing sub-circuit comprises an inverter, wherein:

the inverter has an inputting terminal coupled to the timing sub-circuit and configured to receive the conduction controlling signal, and an outputting terminal coupled to the outputting circuit and configured to output the third controlling signal to the outputting circuit.

For another example, the voltage dividing circuit comprises: a second resistor and a third resistor, wherein:

the second resistor has a first terminal coupled to the DC power supply terminal, and a second terminal coupled to a first terminal of the third resistor and the controlling sub-circuit respectively and configured to output the first controlling signal; and the third resistor has a second electrode coupled to the ground terminal.

For another example, the outputting circuit has a controlling terminal coupled to the controlling circuit and configured to receive the third controlling signal, a first inputting terminal coupled to the charging and discharging circuit and configured to receive the high-level voltage signal, a second inputting terminal coupled to the ground terminal, and an outputting terminal coupled to the gate of the thin film transistor in the liquid crystal display device.

According to another aspect of the embodiments of the disclosure, there is provided a liquid crystal display device comprising the erasing unit according to any one of above embodiments of the disclosure.

According to another aspect of the embodiments of the disclosure, there is provided a method for controlling the erasing unit according to above embodiments of the disclosure, comprising:

outputting, by the controlling circuit, the second controlling signal and the third controlling signal in response to the voltage of the first controlling signal being less than or equal to the reference voltage, outputting, by the charging and discharging circuit, the high-level voltage signal to the outputting circuit under the control of the second controlling signal; and outputting, by the outputting circuit, the high-level voltage signal to the gate of the thin film transistor in the liquid crystal display device, under the control of the third controlling signal.

For example, the erasing unit further comprises a voltage dividing circuit, and the method further comprising: dividing, by the voltage dividing circuit, the voltage of the DC power supply terminal, so as to generate the first controlling signal.

For another example, the controlling circuit comprises a comparing sub-circuit, a selecting sub-circuit, a timing sub-circuit, and an inverting sub-circuit, and the method further comprising:

receiving, by the comparing sub-circuit, the first controlling signal and a reference voltage signal, and outputting a first selecting signal to the selecting sub-circuit in response to the voltage of the first controlling signal being less than or equal to the reference voltage of the reference voltage signal;

outputting, by the selecting sub-circuit, a timing controlling signal of a first level to the timing sub-circuit under a control of the first selecting signal;

timing, by the timing sub-circuit, the duration of the timing controlling signal with the first level and outputting a conduction controlling signal to the inverting sub-circuit during a period of time with a duration being less than or equal to a threshold duration; and inverting, by the inverting sub-circuit, the conduction controlling signal, and outputting the inverted signal to the outputting circuit as the third controlling signal.

For another example, the controlling circuit comprises a comparing sub-circuit, a selecting sub-circuit, and a timing sub-circuit, and the method further comprising: receiving, by the comparing sub-circuit, the first controlling signal and a reference voltage signal, and outputting the second selecting signal to the selecting sub-circuit in response to the voltage of the first controlling signal being greater than the reference voltage of the reference voltage signal; outputting, by the selecting sub-circuit, a timing controlling signal of a second level to the timing sub-circuit under a control of the second selecting signal; and disabling, by the timing sub-circuit, the erasing unit under a control of the timing controlling signal of the second level.

DETAILED DESCRIPTION

Figure 1:
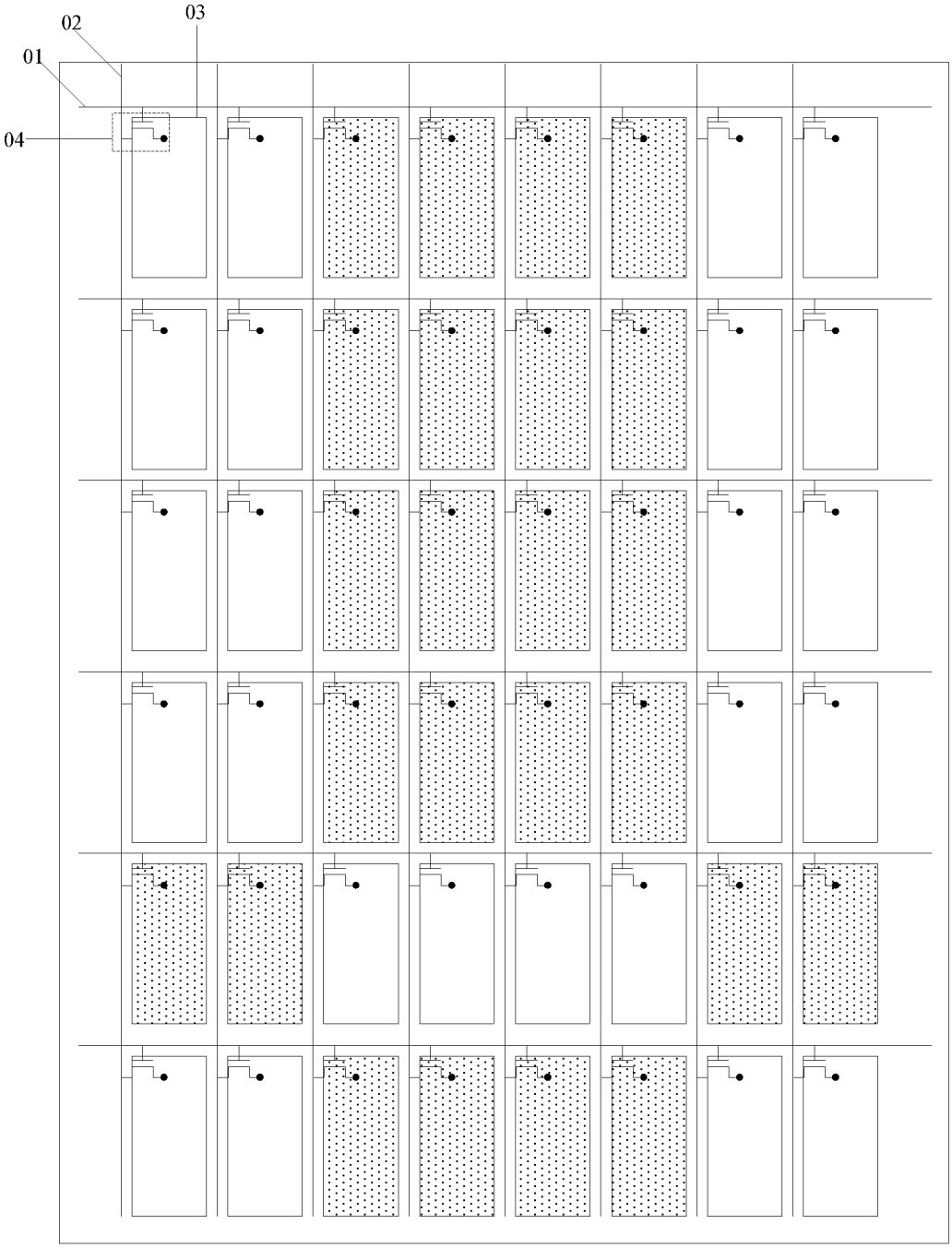
FIG. 1 shows a schematic structural view illustrating an array substrate of a liquid crystal display device.

In order to make objectives, solutions and advantages of the present disclosure more clearly, an erasing unit for image sticking and a controlling method thereof and a liquid crystal display device having the same according to the embodiments of the present disclosure will be described in detail below with reference to the accompanying drawings and specific implementations. It should be noted that the preferred embodiments described below are only to be construed as illustrative but not limiting. The embodiments in the present application and the features in the embodiments may be combined with each other without conflict.

Further, the size and shape of respective figures in the drawings are not intended to represent a true scaling of the erasing unit, but only to illustrate the disclosure.

As shown in FIG. 1, an array substrate of the liquid crystal display device may include a gate line 01, a data line 02, a pixel electrode 03 disposed in an area defined by the gate line 01 and the data line 02, and a TFT 04 corresponding to each pixel electrode 03. The TFT 04 has a gate coupled to the gate line 01, a source coupled to the data line 02, and a drain coupled to the pixel electrode 03. When the liquid crystal display device performs displaying, gate scanning signals are sequentially inputted to each row of gate lines 01, so as to control turning on of each row of TFTs. When the TFTs are turned on, corresponding data signals are loaded to the data lines 02, so as to write the data signals into the pixel electrode. Further, a common voltage is applied to the common electrode on the color filter substrate in the liquid crystal display device, so as to form an electric field by the common voltage and the voltage of the pixel electrode, thereby controlling the deflecting of the liquid crystal molecules in the liquid crystal display device to realize an image display function. The liquid crystal display device can be supplied with a DC voltage, in other words, the voltage at the DC power supply terminal is used to supply power to the liquid crystal display device. In practical applications, the voltage at the DC power supply terminal can be obtained from an external DC power supply (typically 12V) through a step-down circuit. The external DC power supply can be a battery, a DC voltage which is converted from the voltage outputted from the battery by a direct current-direct current (DC-DC) conversion circuit, or a DC voltage which is converted from an AC voltage by an alternating current-direct current (AC-DC) conversion circuit, which will not be limited herein. When the liquid crystal display device is turned on and in a normal operation, the voltage at the DC power supply terminal is a fixed voltage. When the liquid crystal display device is turned off, the external DC power supply is powered down, so that the voltage at the DC power supply terminal drops until it becomes 0V.

In practical applications, there may be a parasitic capacitor and a storage capacitor in the liquid crystal display device. Due to the influence of the capacitors, some of charges may be stored on the pixel electrode. If the stored charges cannot be effectively released, image sticking may be occurred when the liquid crystal display device is turned off. This may cause a shutdown afterimage. In order to solve the problem of the shutdown afterimage, the voltage at the DC power supply terminal DVDD can be detected. A triggering signal XAO (Output ALL-ON Control) is generated in response to the voltage at the DC power supply terminal DVDD being detected to fall to a predetermined voltage value. The triggering signal XAO controls a level conversion circuit to output a high-level signal Vgh (even if the level conversion circuit activates a XAO function), so as to control all thin film transistors (TFTs) in the array substrate to be turned on, thereby enabling the pixel electrodes to discharge the charges. This may help in mitigating the phenomenon of shutdown afterimage. However, the voltage of the high-level signal Vgh is also converted from the external DC power supply by a boosting circuit generally. Therefore, when the liquid crystal display device is turned off, that is, when the external DC power supply is powered down, the voltage of the external DC power supply drops, so that the voltage of the high-level signal Vgh also drops. Since the triggering signal XAO is required to be triggered when the voltage at the DC power supply terminal DVDD drops to a predetermined voltage value, and currently the voltage of the high-level signal Vgh also drops to a certain voltage, the voltage of the high-level signal Vgh which is applied on the TFT is insufficient to turn on the TFT completely in a case that the level conversion circuit actives the XAO function, thereby causing an insufficient charge release. This may result in a residual charge phenomenon, affecting the erasing effect for image sticking.

Embodiments of the present disclosure provide an erasing unit for image sticking that can be applied to a liquid crystal display device. The charging and discharging circuit may achieve discharging when the liquid crystal display device is turned off, thereby ensuring that the voltage supplied to the gate of the TFT does not drop rapidly as the external DC power supply is powered down. Thus, the TFT can be enabled to be turned on completely and the turning-on time of the TFT can be extended. Accordingly, the charges can be completely released, thereby mitigating the residual charge phenomenon.

Figure 2A:
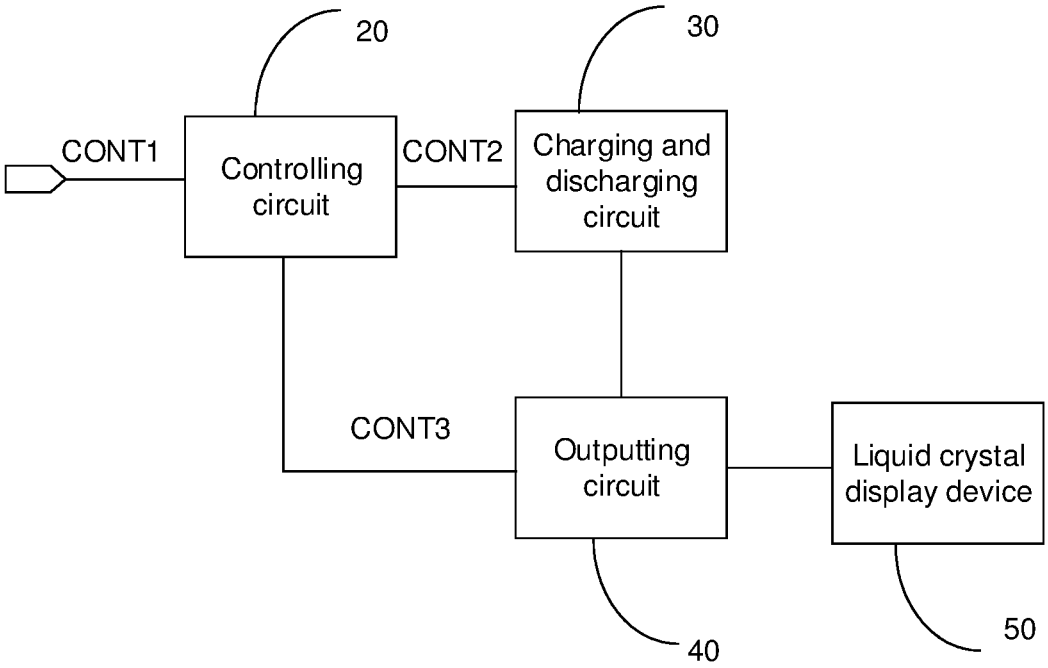
FIG. 2A shows a structural diagram illustrating an erasing unit for image sticking according to embodiments of the present disclosure.

As shown in FIG. 2A, the erasing unit for image sticking in the above liquid crystal display device according to the embodiment of the present disclosure may include a controlling circuit 20, a charging and discharging circuit 30 and an outputting circuit 40. The controlling circuit 20 may be configured to receive a first controlling signal CONT1, and output a second controlling signal CONT2 and a third controlling signal CONT3 in response to a voltage of the first controlling signal CONT1 being less than or equal to a reference voltage. The charging and discharging circuit 30 may be configured to output a high-level voltage signal under a control of the second controlling signal CONT2. The outputting circuit 40 may be configured to output the high-level voltage signal to a gate of a thin film transistor in the liquid crystal display device 50 under a control of the third controlling signal CONT3.

For example, the first controlling signal CONT1 can be derived by dividing the voltage at the DC power supply terminal. According to the embodiment of the present disclosure, when the liquid crystal display device is turned off, the voltage at the DC power supply terminal drops. Thus, the voltage of the first controlling signal is decreased to be less than or equal to the reference voltage, which may enable the controlling circuit to output the second controlling signal CONT2 and the third controlling signal CONT3. The charging and discharging circuit discharges in response to receiving the second controlling signal CONT2, so as to provide the high-level voltage signal to the outputting circuit. The outputting circuit may transfer the high-level voltage signal outputted from the charging and discharging circuit to the gate of the TFT in the liquid crystal display device in response to receiving the third controlling signal CONT3, thereby controlling the TFT to be turned on. Therefore, the voltage of the high-level voltage signal supplied to the outputting circuit is ensured not to drop rapidly as the external DC power supply is powered off, by discharging via the charging and discharging circuit when the liquid crystal display device is turned off. Thus, the TFT can be enabled to be turned on completely and the turning-on time of the TFT can be extended. Accordingly, the charges can be completely released, thereby mitigating the residual charge phenomenon and improving the erasing effect for image sticking.

According to the embodiment of the present disclosure, the charging and discharging circuit has a charging function and a discharging function. When the liquid crystal display device is turned on and in the normal operation, the voltage at the DC power supply terminal does not drop. Thus, the voltage of the first controlling signal CONT1 is ensured not to be less than or equal to the reference voltage. Accordingly, the second controlling signal CONT2 and the third controlling signal CONT3 will not be generated by the controlling circuit, thereby preventing the charging and discharging circuit from discharging and preventing the operation of the outputting circuit from affecting the normal operation of the liquid crystal display device. Moreover, the charging and discharging circuit can be charged when the liquid crystal display device is turned on and in the normal operation.

Figure 2B:
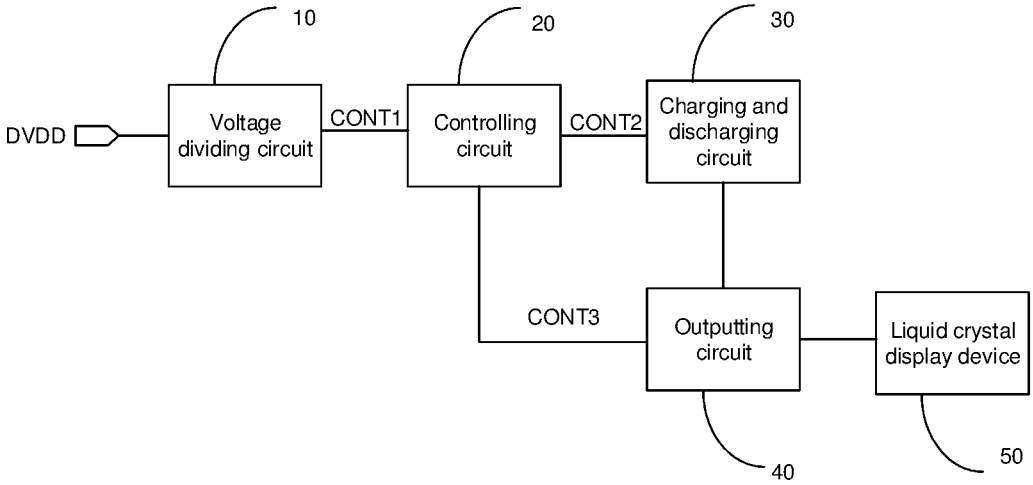
FIG. 2B shows a structural diagram illustrating the erasing unit for image sticking according to the embodiments of the present disclosure.

Further, as shown in FIG. 2B, another example of the erasing unit according to the embodiment of the present disclosure may further include a voltage dividing circuit 10 configured to divide a voltage at the DC power source terminal DVDD, so as to generate the first controlling signal CONT1.

Figure 3:
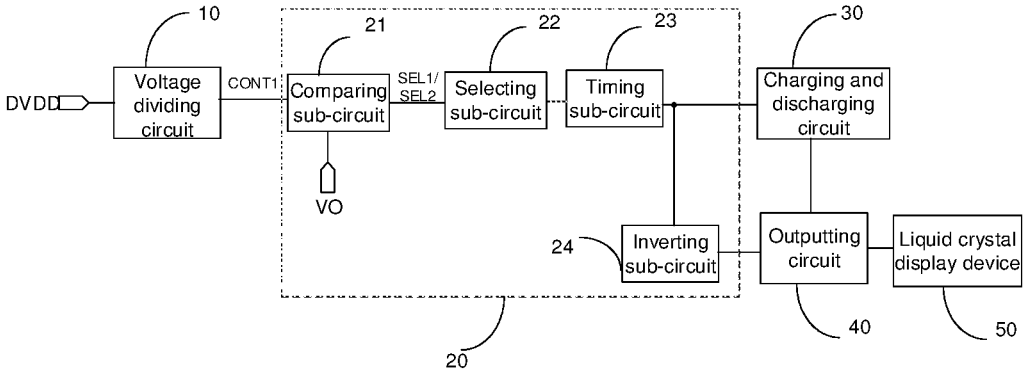
FIG. 3 shows another structural diagram illustrating the erasing unit for image sticking according to the embodiments of the present disclosure.

As shown in FIG. 3, according to the erasing unit of the embodiment of the present disclosure, the controlling circuit 20 may comprise a comparing sub-circuit 21, a selecting sub-circuit 22, a timing sub-circuit 23, and an inverting sub-circuit 24.

The comparing sub-circuit 21 is configured to receive the first controlling signal CONT1 and a reference voltage signal VO, output a first selecting signal SEL1 to the selecting sub-circuit 22 in response to the voltage of the first controlling signal CONT1 being less than or equal to the reference voltage of the reference voltage signal VO; and output a second selecting signal SEL2 to the selecting sub-circuit 22 in response to the voltage of the first controlling signal CONT1 being greater than the reference voltage of the reference voltage signal VO.

The selecting sub-circuit 22 is configured to output a timing controlling signal of a first level to the timing sub-circuit 23 under a control of the first selecting signal SEL1; and output a timing controlling signal of a second level to the timing sub-circuit 23 under a control of the second selecting signal SEL2.

The timing sub-circuit 23 is configured to time a duration of the timing controlling signal of the first level, output a conduction controlling signal during a period of time with a duration being less than or equal to a threshold duration, and disable the erasing unit under the control of the timing controlling signal of the second level.

The inverting sub-circuit 24 is configured to invert the conduction controlling signal and output the inverted signal to the outputting circuit 40 as the third controlling signal CONT3.

The requirement for erasing image sticking, also the discharging requirement, may be different depending on the size of the display panel in the liquid crystal display device and its application environment. For example, the larger the size of the display panel, the longer it takes to discharge. Therefore, in the specific implementation, a threshold for the duration can be set according to the discharging requirement of the liquid crystal display device. For example, when the liquid crystal display device is required to be discharged for a long time, the threshold duration can be set to a great value.

The present disclosure will be described in detail below in conjunction with specific embodiments. It should be noted that the present embodiment is intended to better explain the present disclosure and does not limit the disclosure.

Figure 4:
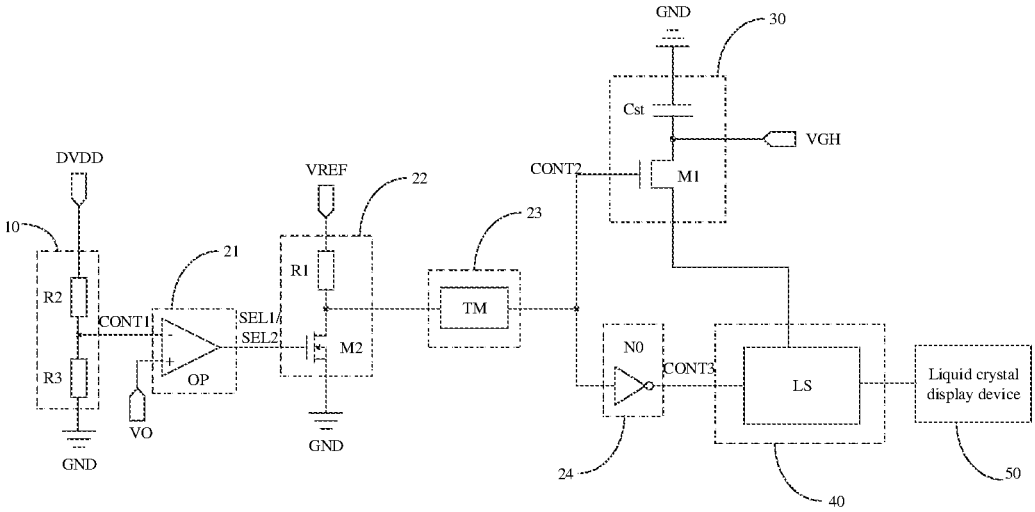
FIG. 4 shows a structural diagram illustrating the erasing unit for image sticking according to the embodiments of the present disclosure.
Figure 5:
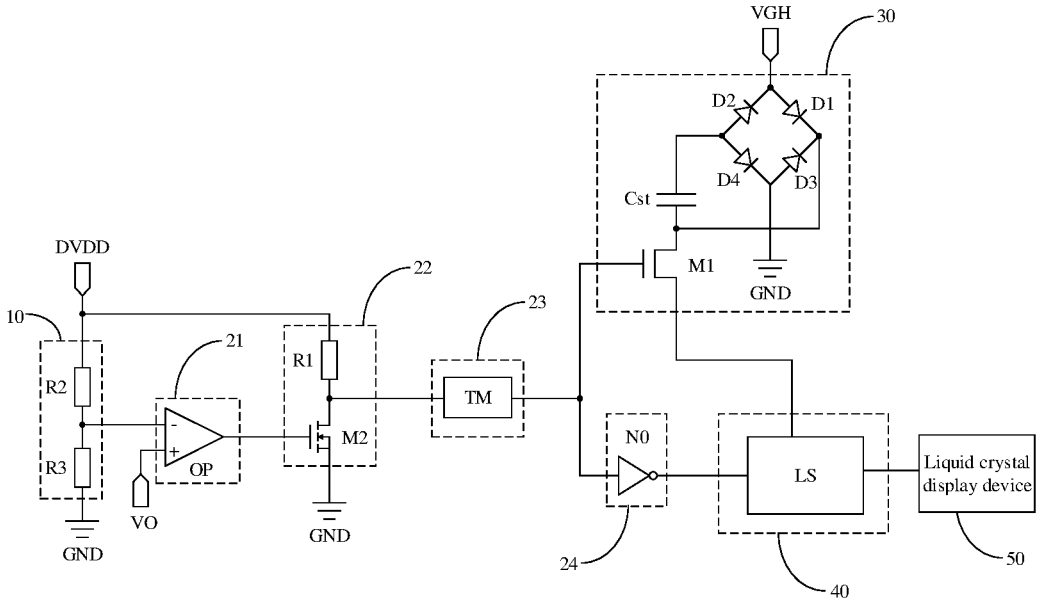
FIG. 5 shows another structural diagram illustrating the erasing unit for image sticking according to the embodiments of the present disclosure.

As shown in FIG. 4 and FIG. 5, in the erasing unit according to the embodiment of the present disclosure, the voltage dividing sub-circuit 10 comprises: a second resistor R2 and a third resistor R3. The second resistor R2 has a first terminal coupled to the DC power supply terminal DVDD, and a second terminal coupled to a first terminal of the third resistor R3 and the controlling circuit respectively and configured to output the first controlling signal. The third resistor R3 has a second electrode coupled to the ground terminal GND. In particular, the second electrode of the second resistor R2 is coupled to the comparing sub-circuit 21 in the controlling circuit.

The second resistor R2 and the third resistor R3 may divide the voltage between the DC power supply terminal DVDD and the ground terminal GND. Moreover, the voltage V1 at the second electrode of the second resistor R2 be as follows:

$$V_1 = \frac{V_{dd}}{r_2 + r_3} r_3,$$

wherein $V_{dd}$ represents the voltage at the DC power supply terminal DVDD, $r_2$ represents the resistance value of the second resistor R2, and $r_3$ represents the resistance value of the third resistor R3.

As shown in FIG. 4 and FIG. 5, in the erasing unit according to the embodiment of the present disclosure, the comparing sub-circuit 21 may comprise a comparator OP, wherein the comparator OP has a negative phase inputting terminal coupled to the voltage dividing circuit 10 and configured to receive the first controlling signal CONT1, a positive phase inputting terminal configured to receive the reference voltage signal VO, and an outputting terminal coupled to the selecting sub-circuit 22 and configured to output the first selecting signal SEL1 or the second selecting signal SEL2. In an example, the negative phase inputting terminal of the comparator OP is coupled to the second electrode of the second resistor R2 in the voltage dividing sub-circuit 10.

The comparator OP can output the high-level signal when the voltage at its negative phase inputting terminal is less than or equal to the voltage at its positive phase inputting terminal; and output the low-level signal when the voltage at its negative phase inputting terminal is greater than the voltage at its positive phase inputting terminal. In the erasing unit of above-described embodiment of the present disclosure, $V_o$ represents the reference voltage of the reference voltage signal. In other words, when $V_1 \leq V_o$, the comparator outputs the high-level signal as the first selecting signal. When $V_1 \geq V_o$, the comparator outputs the low-level signal as the second selecting signal. In practical applications, the voltage at the DC power supply terminal is relatively stable when the liquid crystal display device is turned on and in the normal operation. At this time, $V_1$ can be considered as a fixed voltage value, and $V_1 > V_o$. When the liquid crystal display device is turned off, the voltage at the DC power supply terminal will drop, and $V_1$ will drop accordingly. Thus, $V_1 \leq V_o$ will occur during the dropping. A voltage dropping speed of the DC power supply terminal should be determined according to the actual application environment, which is not limited herein. In practical applications, $V_o$, $r_2$, and $r_3$ may be also determined according to the above circumstances, and are not limited herein.

As shown in FIG. 4 and FIG. 5, the selecting sub-circuit 22 may comprise a second transistor M2 and a first resistor R1. The second transistor M2 has a controlling electrode coupled to the comparing sub-circuit 21 and configured to receive the first selecting signal or the second selecting signal, a first electrode coupled to the ground terminal GND, and a second electrode coupled to a first terminal of the first resistor R1 and the timing sub-circuit 23 respectively and configured to output the timing controlling signal. The first resistor R1 has a second electrode coupled to the reference signal terminal VREF. The controlling electrode of the second transistor M2 is coupled to the outputting terminal of the comparator OP in the comparing sub-circuit 21.

The timing controlling signal may have a first level of a low-level and a second level of a high-level. In the erasing unit of the above embodiment of the present disclosure, if the second transistor M2 is turned on under the control of the first selecting signal, the reference signal terminal will be conducted with the ground terminal. The voltage between the reference signal terminal and the ground terminal may be divided by the first resistor. Since the timing sub-circuit is coupled to the first electrode of the first resistor, the signal at the ground terminal is outputted to the timing sub-circuit 23 as the timing controlling signal of the first level. If the second transistor M2 is turned off under the control of the second selecting signal, the reference signal terminal is disconnected from the ground terminal. Since the timing sub-circuit is coupled to the first electrode of the first resistor, the signal at the reference signal terminal is outputted to the timing sub-circuit as the timing controlling signal of the second level.

In practical applications, the second transistor may be a TFT or a metal oxide semiconductor (MOS) field effect transistor, which is not limited herein. Moreover, the second transistor may have the controlling electrode implemented with a gate, the first electrode implemented with a source, and the second electrode implemented with a drain, or, conversely, the first electrode implemented with the drain, and the second electrode implemented with the source, which is not limited here.

Furthermore, in order to simplify the setting of the signal lines, the reference signal terminal and the DC power supply terminal may be set as the same signal terminal. As shown in FIG. 5, the second electrode of the first resistor R1 can be coupled to the DC power supply terminal DVDD. Thus, when the second transistor M2 is turned off under the control of the second selecting signal, the signal at the DC power supply terminal DVDD can be outputted to the timing sub-circuit 23 as the timing controlling signal of the second level.

As shown in FIG. 4 and FIG. 5, the timing sub-circuit 23 may comprise a timer TM, wherein: the timer TM has a controlling terminal coupled to the selecting sub-circuit 22 and configured to receive the timing controlling signal, and an outputting terminal coupled to the inverting sub-circuit 24 and the charging and discharging circuit 30 and configured to output the conduction controlling signal. The controlling terminal of the timer TM is coupled to the first electrode of the first resistor R1 in the selecting sub-circuit 22.

The timer may be triggered to start operation and timing under the control of the timing controlling signal of the first level, and output the conduction controlling signal during a period of time with a duration being less than or equal to the threshold duration. The timer may not be triggered under the control of the timing controlling signal having the second level, so as to be disabled. When the duration is greater than the threshold duration, the timer can also be disabled, so as to avoid excessive power consumption due to the long duration of the timer.

The timer can be a timer with a countdown function, and the duration of the timer can be a period from the start of the countdown to the countdown to a certain time. The duration of the countdown may be on the order of milliseconds, for example, 20 ms.

In practical applications, the timer also needs to be powered on. Generally, the voltage derived by converting the voltage of the external DC power supply can be supplied to the timer. This may result in that the voltage supplied to the timer decreases as the voltage of the external DC power source decreases when the liquid crystal display device is turned off. Therefore, after completing the shutdown process of the liquid crystal display device, if the duration of the timer is still not greater than the threshold duration, the timer will also stop working. Moreover, when the liquid crystal display device is powered on again, the timer can be reset automatically or manually.

The threshold duration can be set for the countdown duration of the timer. Moreover, the specific structure of the timer can be understood by those of ordinary skill in the art, and details thereof are not described herein.

As shown in FIG. 4 and FIG. 5, the inversing sub-circuit 24 comprises an inverter N0, wherein: the inverter N0 has an inputting terminal coupled to the outputting terminal of the timing sub-circuit 23 and configured to receive the conduction controlling signal, and an outputting terminal coupled to the outputting circuit 40 and configured to output the third controlling signal CONT3. The inputting terminal of the inverter N0 is coupled to the outputting terminal of the timer TM in the timing sub-circuit 23.

For example, the inverter N0 can enable the signal at its outputting terminal to have an opposite phase with the signal at its inputting terminal. The specific structure of the inverter can be understood by those skilled in the art and will not be described herein.

As shown in FIG. 4, the charging and discharging circuit 30 may comprise: a storage capacitor Cst and a first transistor M1. The storage capacitor Cst has a first electrode coupled to a high-level voltage signal terminal VGH and a first electrode of the first transistor M1, and a second electrode coupled to a ground terminal GND. The first transistor M1 has a gate coupled to the controlling sub-circuit and configured to receive the second controlling signal CONT2, and a second electrode coupled to the outputting circuit 40 and configured to output the high-level voltage signal. The gate of the first transistor M1 may be coupled to the outputting terminal of the timer TM in the timing sub-circuit 23.

The first transistor M1 may be turned on under the control of the second controlling signal, so as to connect the first electrode of the storage capacitor Cst to the outputting circuit. The first transistor may be a TFT or a MOS transistor, which is not limited herein. Moreover, the first transistor have the controlling electrode implemented with the gate, the first electrode implemented with the source, and the second electrode implemented with the drain, and vice versa, which is not limited herein.

The storage capacitor Cst has a charging and discharging function. The storage capacitor Cst can be implemented as a single capacitor or a capacitor bank. The size of the storage capacitor Cst can be determined according to the actual application environment, which is not limited herein. When the liquid crystal display device is turned on and in the normal operation, the voltage at the high-level voltage signal terminal can be obtained by converting the voltage of the external DC power supply via a boosting circuit. In a specific implementation, when the liquid crystal display device is turned on and in the normal operation, the storage capacitor Cst can be charged by inputting the signals at the high-level voltage signal terminal and the ground terminal, so as to store the voltage at the high-level voltage signal terminal. When the liquid crystal display device is turned off, the first transistor M1 is turned on. The voltage at the high-level voltage signal terminal drops accordingly. The storage capacitor Cst can be discharged through the turned-on first transistor M1, so as to output the high-level voltage signal to the outputting circuit. In particular, when the storage capacitor Cst starts to discharge, the voltage of the high-level voltage signal outputted by the storage capacitor is approximately equal to the voltage at the high-level voltage signal terminal (in practice, the voltage outputted by the storage capacitor Cst may be slightly smaller than the voltage at the high-level voltage signal terminal). As the discharging time of the storage capacitor Cst increases, the voltage of the outputted high-level voltage signal will gradually decrease. In practical applications, since the storage capacitor Cst is capable of storing a voltage, the speed at which the voltage resulted from the discharging of the storage capacitor decreases is smaller than the speed at which the voltage at the DC power source terminal decreases. Therefore, due to the discharging of the storage capacitor, the high-level voltage signal can be supplied to all the TFTs in the liquid crystal display device, enabling the TFT to be turned on completely. The speed at which the voltage outputted by the storage capacitor Cst decreases may be determined according to the size of the storage capacitor, and is not limited herein.

Under the premise of ensuring that all TFTs in the liquid crystal display device are turned on, the voltage at the high-level voltage signal terminal can be made smaller than the voltage at the DC power supply terminal, thereby reducing power consumption.

The voltage at the high-level voltage signal terminal may be disturbed by the signal in the liquid crystal display device, and thus there may be some small fluctuations. As shown in FIG. 5, in order to avoid the influence of the fluctuation on the charging of the storage capacitor, the charging and discharging circuit 30 may further comprise: a first rectifier diode D1, a second rectifier diode D2, a third rectifier diode D3, and a fourth rectifier diode D4. The high-level voltage signal terminal VGH is coupled to the first electrode of the storage capacitor Cst via the first rectifier diode D1 and coupled to the second electrode of the storage capacitor Cst via the second rectifier diode D2. The ground terminal GND is coupled to the first electrode of the storage capacitor Cst via the third rectifier diode D3, and coupled to the second electrode of the storage capacitor Cst through the fourth rectifier diode D4. The first rectifier diode D1 has an anode coupled to the high-level voltage signal terminal VGH and a cathode of the second rectifier diode D2 respectively, and a cathode coupled to the first electrode of the storage capacitor Cst and a cathode of the third rectifier diode D3 respectively. The second rectifier diode D2 has an anode coupled to the second electrode of the storage capacitor Cst and an anode of the fourth rectifier diode D4 respectively. The third rectifier diode D3 has an anode coupled to the ground terminal GND and a cathode of the fourth rectifier diode D4 respectively The first rectifier diode, the second rectifier diode, the third rectifier diode and the fourth rectifier diode may constitute a bridge rectifier circuit, so that the influence of the voltage fluctuation at the high-level voltage signal terminal on the charging of the storage capacitor Cst can be reduced. In practical applications, the specific structure of each of the above rectifier diodes can be understood by those of ordinary skill in the art, and details thereof are not described herein.

As shown in FIG. 4 and FIG. 5, the outputting circuit 40 may have a level conversion circuit LS. The level conversion circuit LS has a controlling terminal coupled to the controlling circuit and configured to receive the third controlling signal CONT3, a first inputting terminal coupled to the charging and discharging circuit 30 and configured to receive the high-level voltage signal, a second inputting terminal coupled to the ground terminal GND, and an outputting terminal coupled to the gate of the thin film transistor in the liquid crystal display device 50. For example, the controlling terminal of the level conversion circuit LS is coupled to the outputting terminal of the invertor N0 in the inverting sub-circuit 24. The first inputting terminal of the level conversion circuit LS is coupled to the second electrode of the first transistor M1 in the charging and discharging circuit 30.

The outputting circuit is triggered to activate the XAO function under the control of the third controlling signal CONT3, and may output the high-level voltage signal inputted to the first inputting terminal, so as to control all TFTs in the liquid crystal display device to be turned on, thereby releasing the charges on the pixel electrodes. The outputting circuit can perform level conversion during the rest of the operate time, for example, output the level-converted clock signal so as to avoid adverse effects on the normal display of the liquid crystal display device. Moreover, the specific structure and function of the outputting circuit can be understood by those skilled in the art, and details thereof are not described herein.

The above description only illustrates a specific structure of each circuit in the erasing unit for image sticking according to the embodiment of the present disclosure. The specific structure of the above-mentioned circuits is not limited to the above-mentioned structure of the embodiments of the present disclosure, and may be other structures known to those skilled in the art, which are not limited herein.

The operation process of the erasing unit according to the embodiment of the present disclosure is described below by taking the structure shown in FIG. 5 as an example. Since the erasing unit is applied to the liquid crystal display device, the following description will be made in connection with the startup process, normal operation process, and shutdown process of the liquid crystal display device.

When the liquid crystal display device 50 is turned on and in the normal operation, the voltage $V_{dd}$ at the DC power supply terminal DVDD is stabilized to a fixed voltage $V_{dd0}$. The voltage $V_{dd}$ at the DC power supply terminal DVDD can be divided by the second resistor R2 and the third resistor R3, such that the voltage at the second terminal of the second resistor R2 is maintained at a fixed voltage of $$V_1 = \frac{V_{dd}}{r_2 + r_3} r_3 = \frac{V_{dd0}}{r_2 + r_3} r_3.$$

At this time, since $V_1 > V_o$, the comparator OP outputs a low-level signal and transfer the low-level signal to the second transistor M2 as the second selecting signal SEL2, so as to control the second transistor M2 to be turned off. This results in that the reference signal terminal VREF is disconnected from the ground terminal GND. Thus, the signal at the reference signal terminal VREF can be outputted to the timer TM as the timing controlling signal of a high-level, controlling the timer TM to be disabled. Since the timer TM is disabled, the first transistor M1 is turned off. Therefore, the storage capacitor Cst will not be discharged. Accordingly, at this time, the storage capacitor Cst can store the voltage at the high-level voltage signal terminal VGH by the rectification of the first to fourth rectifier diodes D1 to D4. Since the timer TM is disabled, there is no third controlling signal inputted into the level shifter LS, and thus the level shifter LS does not perform the XAO function. Therefore, the image display effect of the liquid crystal display device will not be adversely affected.

When the liquid crystal display device 50 is turned off, the voltage at the DC power supply terminal DVDD starts to decrease. The voltage $V_{dd}$ at the DC power supply terminal DVDD is divided by the second resistor R2 and the third resistor R3, so that the voltage $$V_1 = \frac{V_{dd}}{r_2 + r_3} r_3$$

at the second terminal of the second resistor R2 also starts to decrease. When $V_1 \leq V_o$, the comparator OP outputs a high-level signal and transfer the high-level signal to the second transistor M2 as the first selecting signal SEL1, so as to control the second transistor M2 to be turned on. This may result in connecting the reference signal terminal VREF with the ground terminal GND. Accordingly, the signal at the ground terminal GND can be output to the timer TM as a timing controlling signal of a low-level, controlling the timer TM to start timing. The conduction controlling signal of a high-level may be inputted to the first transistor M1 and the inverter N0, respectively, during a period of time in which the duration of the timer TM is less than or equal to the threshold duration. The first transistor M1 is turned on under the control of the conduction controlling signal. The storage capacitor Cst starts to discharge, so as to supply the stored voltage to the level conversion circuit LS. The inverter N0 inverts the conduction controlling signal of the high-level into the third controlling signal CONT3 of the low-level and supplies the inverted signal to the level conversion circuit LS, so as to trigger the level conversion circuit LS to activate the XAO function operation by the third controlling signal. When the level conversion circuit LS is in operation, the high-level voltage signal outputted by the storage capacitor can be supplied to all TFTs in the liquid crystal display device 50, so as to turn on all TFTs for charge releasing.

According to an embodiment of the present disclosure, when the liquid crystal display device is turned off, the high-level voltage signal is supplied to all TFTs in the liquid crystal display device by the discharging of the storage capacitor. In other words, the storage capacitor is used as a power source to supply power to the gates of all TFTs. Compared with supplying power to the gates of all TFTs with the high-level signal Vgh directly, the erasing unit according to the embodiment of the present disclosure can avoid the problem that the TFTs are insufficiently turned-on due to the decreasing of the voltage applied to the gates of the TFTs. Thus, the charge can be effectively released and the residual charge phenomenon can be avoided.

According to the embodiment of the present disclosure, when the liquid crystal display device is turned on and in the normal operation, the operation of the storage capacitor and the outputting circuit can be disabled by disabling the timer, thereby reducing the influence on the normal display effect of the liquid crystal display device. When the liquid crystal display device is turned off, by controlling the timer to control the discharging time of the storage capacitor, it is possible to ensure the operate time for discharging the storage capacitor to be accurate. Furthermore, by using the timer to trigger the outputting circuit, it is also possible to ensure the outputting circuit to have sufficient operate time.

Figure 6:
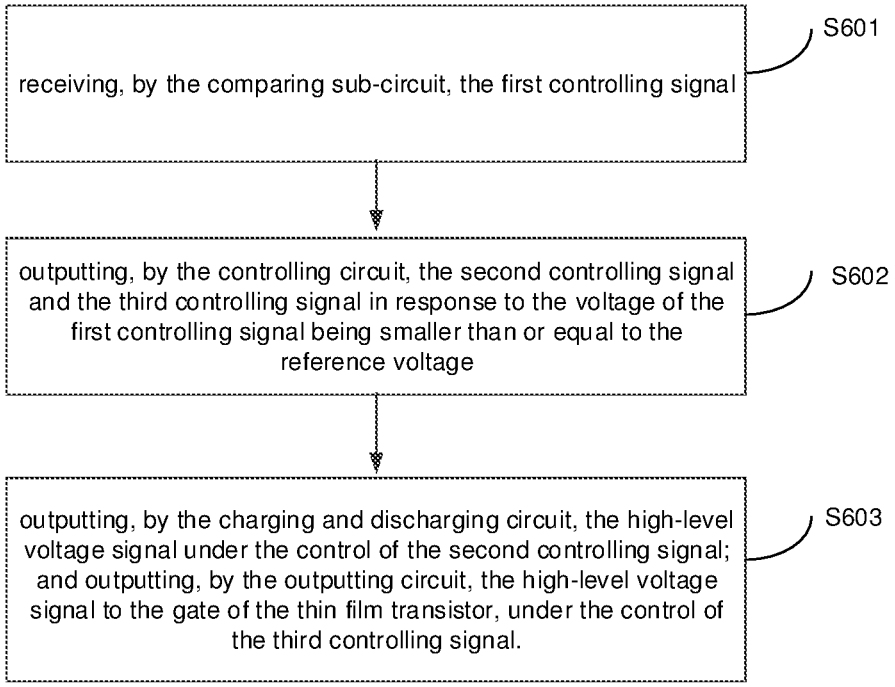
FIG. 6 shows a flow chart illustrating a method for controlling the erasing unit according to the embodiments of the present disclosure.

The embodiment of the present disclosure further provides a method for controlling the erasing unit. As shown in FIG. 6, the method may comprise the following steps.

At step S601, the controlling circuit may receive the first controlling signal.

At step S602, the controlling circuit may output a second controlling signal and a third controlling signal in response to a voltage of the first controlling signal being less than or equal to a reference voltage.

At step S603, the charging and discharging circuit may output a high-level voltage signal to the outputting circuit under a control of the second controlling signal; and the outputting circuit may output the high-level voltage signal to a gate of a thin film transistor in the liquid crystal display device under a control of the third controlling signal.

In addition, the voltage at the DC power supply terminal may be divided by a voltage dividing circuit, so as to generate the first controlling signal.

According to the above method of the embodiment of the present disclosure, when the liquid crystal display device is turned off, the voltage at the DC power supply terminal decreases, so that the voltage of the first controlling signal is also decreased to be less than or equal to the reference voltage. Therefore, the controlling circuit outputs the second controlling signal and the third controlling signal. The charging and discharging circuit discharges in response to receiving the second controlling signal, so as to provide the high-level voltage signal to the outputting circuit. The outputting circuit operates in response to receiving the third controlling signal, so as to supply the high-level voltage signal outputted from the charging and discharging circuit to the gates of the TFTs in the liquid crystal display device, controlling the TFTs to be turned on. In this way, since the charging and discharging circuit discharges when the liquid crystal display device is turned off, it is ensured that the voltage of the high-level voltage signal supplied to the outputting circuit does not fall rapidly as the external DC power supply is powered off. Thus, the TFTs can be turned on completely and the turning-on time of the TFTs can be extended, enabling a complete releasing of charges and avoiding the residual charge phenomenon.

The method according to the embodiment of the present disclosure may further comprise: receiving, by the comparing sub-circuit, the first controlling signal and a reference voltage signal, and outputting a first selecting signal to the selecting sub-circuit in response to the voltage of the first controlling signal being less than or equal to the reference voltage of the reference voltage signal; outputting, by the selecting sub-circuit, a timing controlling signal of a first level to the timing sub-circuit under a control of the first selecting signal; timing, by the timing sub-circuit, the duration of the timing controlling signal having the first level and outputting a conduction controlling signal to the inverting sub-circuit during a period of time with a duration being less than or equal to a threshold duration; and inverting, by the inverting sub-circuit, the conduction controlling signal, and outputting the inverted signal to the outputting circuit as the third controlling signal.

The method according to the embodiment of the present disclosure may further include: receiving, by the comparing sub-circuit, the first controlling signal and a reference voltage signal, and outputting the second selecting signal to the selecting sub-circuit in response to the voltage of the first controlling signal being greater than the reference voltage of the reference voltage signal; outputting, by the selecting sub-circuit, a timing controlling signal of a second level to the timing sub-circuit under a control of the second selecting signal; disabling, by the timing sub-circuit, the erasing unit under a control of the timing controlling signal of the second level.

In a specific implementation, the first level may be a low-level and the second level may be a high-level.

Based on the same inventive concept, the embodiments of the present disclosure further provides a liquid crystal display device including the erasing unit of the embodiment of the present disclosure. The liquid crystal display device according to the embodiment of the present disclosure is an LCD.

The display device according to the embodiment of the present disclosure may further include: a timing controller, a source driving circuit, and a gate driving circuit. The timing controller controls the source driving circuit to output a data signal and controls the gate driving circuit to output a gate scanning signal, according to the data of the image to be displayed.

In practical applications, when the liquid crystal display device is turned on and in the normal operation, the timing controller can control the source driving circuit to output a data signal according to the data of the image to be displayed. When the liquid crystal display device is turned off, the third controlling signal outputted by the controlling circuit may also control the timing controller to stop controlling of the source driving circuit and the gate driving circuit, so that the source driving circuit stops outputting the data signal and the gate drive circuit stops outputting the gate scanning signal.

The liquid crystal display device according to the embodiment of the present disclosure may be any product or component having a display function, such as a mobile phone, a tablet computer, a television, a display, a notebook computer, a digital photo frame, a navigator, and the like. Other indispensable components for the liquid crystal display device should be understood by those skilled in the art, which are not described herein and neither should be construed as limiting the disclosure.

It will be apparent to those skilled in the art that various changes and modifications can be made in the present disclosure without departing from the spirit and scope of the disclosure. If such changes and modifications fall into the scope of the present disclosure claimed by the claims and its equivalents, the present disclosure should be intended to cover those changes and modifications.

We claim:

1. An erasing unit for image sticking in a liquid crystal display device, comprising:

a controlling circuit, configured to receive a first controlling signal, and output a second controlling signal and a third controlling signal in response to a voltage of the first controlling signal being less than or equal to a reference voltage;

a charging and discharging circuit, coupled to the controlling circuit, and configured to output a high-level voltage signal under a control of the second controlling signal; and an outputting circuit, configured to output the high-level voltage signal to a gate of a thin film transistor in the liquid crystal display device under a control of the third controlling signal, wherein the controlling circuit comprises: a comparing sub-circuit, a selecting sub-circuit, a timing sub-circuit, and an inverting sub-circuit, wherein:

the comparing sub-circuit configured to receive the first controlling signal and a reference voltage signal, output a first selecting signal to the selecting sub-circuit in response to the voltage of the first controlling signal being less than or equal to the reference voltage of the reference voltage signal; and output a second selecting signal to the selecting sub-circuit in response to the voltage of the first controlling signal being greater than the reference voltage of the reference voltage signal;

the selecting sub-circuit is coupled to the comparing sub-circuit, and configured to output a timing controlling signal of a first level to the timing sub-circuit under a control of the first selecting signal; and output a timing controlling signal of a second level to the timing sub-circuit under a control of the second selecting signal;

the timing sub-circuit is coupled to the charging and discharging circuit and the inverting sub-circuit, and configured to time a duration of the timing controlling signal of the first level, output a conduction controlling signal to the charging and discharging circuit and the inverting sub-circuit during a period of time with a duration being less than or equal to a threshold duration, and disable the erasing unit under the control of the timing controlling signal of the second level; and the inverting sub-circuit is coupled to the timing sub-circuit and the outputting sub-circuit, and configured to invert the conduction controlling signal and output the inverted signal to the outputting sub-circuit as the third controlling signal.

2. The erasing unit of claim 1, further comprising a voltage dividing circuit coupled to the controlling circuit, and configured to generate the first controlling signal by dividing a voltage at a DC power supply terminal.

3. The erasing unit of claim 1, wherein the charging and discharging circuit comprises: a storage capacitor and a first transistor, wherein:

the storage capacitor has a first electrode coupled to a high-level voltage signal terminal and a first electrode of the first transistor, and a second electrode coupled to a ground terminal; and the first transistor has a gate coupled to the controlling circuit and configured to receive the second controlling signal, and a second electrode coupled to the outputting circuit and configured to output the high-level voltage signal.

4. The erasing unit of claim 3, wherein the charging and discharging circuit further comprises: a first rectifier diode, a second rectifier diode, a third rectifier diode, and a fourth rectifier diode; wherein the high-level voltage signal terminal is coupled to the first electrode of the storage capacitor via the first rectifier diode and coupled to the second electrode of the storage capacitor via the second rectifier diode, and the ground terminal is coupled to the first electrode of the storage capacitor via the third rectifier diode, and coupled to the second electrode of the storage capacitor through the fourth rectifier diode;

the first rectifier diode has an anode coupled to the high-level voltage signal terminal and a cathode of the second rectifier diode respectively, and a cathode coupled to the first electrode of the storage capacitor and a cathode of the third rectifier diode respectively;

the second rectifier diode has an anode coupled to the second electrode of the storage capacitor and an anode of the fourth rectifier diode respectively; and the third rectifier diode has an anode coupled to the ground terminal and a cathode of the fourth rectifier diode respectively.

5. The erasing unit of claim 1, wherein the comparing sub-circuit comprises a comparator, wherein the comparator has a negative phase inputting terminal coupled to the voltage dividing sub-circuit and configured to receiving the first controlling signal, and a positive phase inputting terminal configured to receive the reference voltage signal, and an outputting terminal coupled to the selecting sub-circuit and configured to output the first selecting signal or the second selecting signal.

6. The erasing unit of claim 1, wherein the selecting sub-circuit comprises a second transistor and a first resistor;

the second transistor has a controlling electrode coupled to the comparing sub-circuit and configured to receive the first selecting signal or the second selecting signal, a first electrode coupled to the ground terminal, and a second electrode coupled to a first terminal of the first resistor and the timing sub-circuit respectively and configured to output the timing controlling signal; and the first resistor has a second electrode coupled to the reference signal terminal.

7. The erasing unit of claim 6, wherein the reference signal terminal and the DC power supply terminal are the same signal terminal.

8. The erasing unit of claim 1, wherein the timing sub-circuit comprises a timer, wherein:

the timer has a controlling terminal coupled to the selecting sub-circuit and configured to receive the timing controlling signal, and an outputting terminal coupled to the inverting sub-circuit and the charging and discharging circuit and configured to output the conduction controlling signal.

9. The erasing unit of claim 6, wherein the inversing sub-circuit comprises an inverter, wherein:

the inverter has an inputting terminal coupled to the timing sub-circuit and configured to receive the conduction controlling signal, and an outputting terminal coupled to the outputting circuit and configured to output the third controlling signal to the outputting circuit.

10. The erasing unit of claim 2, wherein the voltage dividing circuit comprises: a second resistor and a third resistor, wherein the second resistor has a first terminal coupled to the DC power supply terminal, and a second terminal coupled to a first terminal of the third resistor and the controlling circuit respectively and configured to output the first controlling signal; and the third resistor has a second electrode coupled to the ground terminal.

11. The erasing unit of claim 1, wherein the outputting circuit comprises a level conversion sub-circuit, wherein the level conversion sub-circuit has a controlling terminal coupled to the controlling circuit and configured to receive the third controlling signal, a first inputting terminal coupled to the charging and discharging circuit and configured to receive the high-level voltage signal, a second inputting terminal coupled to the ground terminal, and an outputting terminal coupled to the gate of the thin film transistor in the liquid crystal display device.

12. A liquid crystal display device comprising the erasing unit according to claim 1.

13. A method for controlling the erasing unit according to claim 1, comprising:

outputting, by the controlling circuit, the second controlling signal and the third controlling signal in response to the voltage of the first controlling signal being smaller than or equal to the reference voltage, and suspending its operation in response to the voltage of the first controlling signal being greater than the reference voltage;

outputting, by the charging and discharging circuit, the high-level voltage signal under the control of the second controlling signal; and outputting, by the outputting circuit, the high-level voltage signal to the gate of the thin film transistor in the liquid crystal display device, under the control of the third controlling signal.

14. The method of claim 13, wherein the erasing unit further comprises a voltage dividing circuit, and the method further comprising:

dividing, by the voltage dividing circuit, the voltage of the DC power supply terminal, so as to generate the first controlling signal.

15. The method of claim 13, further comprising:

receiving, by the comparing sub-circuit, the first controlling signal and a reference voltage signal, and outputting a first selecting signal to the selecting sub-circuit in response to the voltage of the first controlling signal being less than or equal to the reference voltage of the reference voltage signal;

outputting, by the selecting sub-circuit, a timing controlling signal of a first level to the timing sub-circuit under a control of the first selecting signal;

timing, by the timing sub-circuit, a duration of the timing controlling signal of the first level and outputting a conduction controlling signal to the charging and discharging circuit and the inverting sub-circuit during a period of time with a duration being less than or equal to a threshold duration; and inverting, by the inverting sub-circuit, the conduction controlling signal, and outputting the inverted signal to the level conversion sub-circuit as the third controlling signal.

16. The method of claim 13, method further comprising:

receiving, by the comparing sub-circuit, the first controlling signal and a reference voltage signal, and outputting the second selecting signal to the selecting sub-circuit in response to the voltage of the first controlling signal being greater than the reference voltage of the reference voltage signal;

outputting, by the selecting sub-circuit, a timing controlling signal of a second level to the timing sub-circuit under a control of the second selecting signal; and disabling, by the timing sub-circuit, the erasing unit under a control of the timing controlling signal of the second level.

* * * * *